US007193589B2

(12) United States Patent
Yoshida et al.

(10) Patent No.: US 7,193,589 B2
(45) Date of Patent: Mar. 20, 2007

(54) DRIVE METHODS AND DRIVE DEVICES FOR ACTIVE TYPE LIGHT EMITTING DISPLAY PANEL

(75) Inventors: Takayoshi Yoshida, Yonezawa (JP); Katsuhiro Kanauchi, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 541 days.

(21) Appl. No.: 10/699,704

(22) Filed: Nov. 4, 2003

(65) Prior Publication Data

US 2004/0090186 A1 May 13, 2004

(30) Foreign Application Priority Data

Nov. 8, 2002 (JP) ..... 2002-325335

(51) Int. Cl.
*G09G 3/30* (2006.01)

(52) U.S. Cl. ..... 345/76; 345/78

(58) Field of Classification Search ..... 345/76–80, 345/36, 45; 315/169.3
See application file for complete search history.

(56) References Cited

U.S. PATENT DOCUMENTS 6,580,657 B2 * 6/2003 Sanford et al. ..... 365/230.05
6,714,177 B1 * 3/2004 Ishizuka ..... 345/76
6,995,737 B2 * 2/2006 LeChevalier ..... 345/82
7,119,768 B2 * 10/2006 Yazawa et al. ..... 345/76

FOREIGN PATENT DOCUMENTS

JP 9-232074 9/1997
JP 2002-169510 6/2002

* cited by examiner

*Primary Examiner*—Ricardo Osorio
(74) *Attorney, Agent, or Firm*—Westerman, Hattori, Daniels & Adrian, LLP

(57) ABSTRACT

In a drive device for an active type light emitting display panel which can apply a reverse bias voltage to an EL element, in order to be able to compensate deterioration in light-emitting efficiency of the EL element accompanied by applying of the reverse bias voltage and the like, one pixel 10 is composed of a controlling TFT (Tr1), the driving TFT (Tr2), a capacitor C1, and the EL element E1. Switching switches SW1, SW2 mutually enables a supplying state of a forward current to the EL element E1 and an applying state of the reverse bias voltage to be selected. In one control form according to the present invention, when the applying state of the reverse bias voltage shifts to the supplying state of the forward current, by switching one switch first, the anode and cathode of the EL element E1 are made to the same electrical potential to allow electrical charges to be discharged. Thus, charge of the forward current for a parasitic capacitance of the EL element E1 can be performed rapidly, and rising of the lighting operation of the EL element can be advanced.

13 Claims, 9 Drawing Sheets

DRIVE METHODS AND DRIVE DEVICES FOR ACTIVE TYPE LIGHT EMITTING DISPLAY PANEL

BACKGROUND OF THE INVENTION

1. Field of the Invention

The present invention relates to drive devices for a light emitting display panel in which a light emitting element constituting a pixel is actively driven by a TFT (thin film transistor) and in which a reverse bias voltage can be applied to the light emitting element, and particularly to drive methods and drive devices for an active type light emitting display panel in which deterioration in light-emitting efficiency of the light emitting element accompanied by applying of the reverse bias voltage and the like can be compensated.

2. Description of the Related Art

A display using a display panel which is constructed by arranging light emitting elements in a matrix pattern has been developed widely. As the light emitting element employed in such a display panel, an organic EL (electroluminescent) element in which an organic material is employed in a light emitting layer has attracted attention. This is because of backgrounds one of which is that by employing, in a light emitting layer of an EL element, an organic compound which enables an excellent light emitting characteristic to be expected, a high efficiency and a long life have been achieved which make an EL element satisfactorily practicable.

As display panels in which such organic EL elements are employed, a simple matrix type display panel in which EL elements are simply arranged in a matrix pattern and an active matrix type display panel in which an active element consisting of a TFT is added to each of EL elements arranged in a matrix pattern have been proposed. The latter active matrix type display panel can realize low power consumption, compared to the former simple matrix type display panel, and has characteristics such as less cross talk between pixels and the like, thereby being specifically suitable for a high definition display constituting a large screen.

FIG. 1 shows one example of a most basic circuit configuration corresponding to one pixel 10 in a conventional active matrix type display panel, which is called a conductance control technique. In FIG. 1, a gate of a controlling TFT (Tr1) comprised of N-channels is connected to a scan line extending from a scan driver 1, and its source is connected to a data line extending from a data driver 2. A drain of the controlling TFT connected to a gate of a driving TFT (Tr2) comprised of P-channels and to one terminal of a capacitor C1 provided for holding electrical charges.

A source of the driving TFT (Tr2) is connected to the other terminal of the capacitor C1 and to an anode side power supply (VHanod) supplying a drive current to an EL element E1 provided as the light emitting element. A drain of the driving TFT (Tr2) is connected to an anode of the EL element E1, and a cathode of this EL element is connected to a cathode side power supply (VLcath) via a switch SW1. This example shown in FIG. 1 is constructed also in such a way that a reverse bias voltage source (VHbb) can be applied to the cathode of the EL element via the switch SW1 as will be explained later.

In the structure shown in FIG. 1, when an ON controlling voltage (Select) is supplied to the gate of the controlling TFT (Tr1) via the scan line, the controlling TFT (Tr1) allows current which matches the voltage (Vdata) supplied from the data line to the source to flow from the source to the drain. Therefore, during the period when the gate of the controlling TFT (Tr1) is at an ON voltage, the capacitor C1 is charged, and the capacitor's voltage is supplied to the gate of the driving TFT (Tr2) as a gate voltage. Thus, the driving TFT (Tr2) allows current based on its gate-to-source voltage (Vgs) to flow through the EL element E1 to drive the EL element so that the EL element emits light.

It is well known that the organic EL element electrically has a light emitting element having a diode characteristic and an electrostatic capacity (parasitic capacitance) connected in parallel thereto, and it has been known that the organic EL element emits light whose intensity is approximately proportional to the forward current of the diode characteristic. It has been also known empirically that by applying a voltage one after another in a reverse direction (reverse bias voltage) which does not participate in light emission to the EL element, the life of the EL element can be prolonged.

The structure shown in FIG. 1 is constructed in such a way that a forward or reverse bias voltage can be applied to the EL element E1, utilizing the switch SW1. That is, an electrical potential relationship among the anode side power supply (VHanod), the cathode side power supply (VLcath), and the reverse bias voltage source (VHbb) is set to VHbb>VHanod>VLcath. Therefore, in the state of the switch SW1 shown in FIG. 1, a forward voltage of the value of (VHanod−VLcath) is supplied to a series circuit of the driving TFT (Tr2) and the EL element E1. When the switch SW1 shown in FIG. 1 is switched to the opposite direction, a reverse bias voltage of the value of (VHbb−VHanod) is supplied to the series circuit of the driving TFT (Tr2) and the EL element E1.

FIG. 2 also, similarly, shows a conventional example constructed in such a manner that the reverse bias voltage can be applied to the EL element, and this example also shows the case where the conductance control technique is applied. In FIG. 2, portions corresponding to the respective portions explained based on FIG. 1 are designated by like reference numerals, and therefore individual explanation thereof will be omitted. The example shown in this FIG. 2 is constructed in such a manner that first and second change-over switches SW1, SW2 are provided so that by switching the switches SW1, SW2, a connection relationship of the anode side power supply (VHanod) and the cathode side power supply (VLcath) is switched.

That is, in the case where the switches SW1, SW2 are in the state shown in the drawing, the forward voltage of the value of (VHanod−VLcath) is supplied to the series circuit of the driving TFT (Tr2) and the EL element E1. Thus, the forward current can be supplied to the EL element E1, and the EL element E1 can be brought to a lighting state by an ON operation of the driving TFT (Tr2). When the switches SW1, SW2 are switched to the directions opposite to that of the drawing, similarly, the reverse bias voltage of the value of (VHanod−VLcath) is supplied to the series circuit of the driving TFT (Tr2) and the EL element E1. A structure of the case where the VLcath is used as a reference potential (ground voltage) is disclosed in Patent Reference 1.

Japanese Patent Application Laid-Open No. 2002-169510 (paragraph Nos. 0001 and 0012, FIG. 2, and the like).

Meanwhile, since the organic EL element is a current light emitting type element, in general, a constant current drive is performed for the driving TFT. The EL element has a predetermined parasitic capacitance as described above, and further the EL element is brought to a light emitting state when a predetermined light emission threshold voltage or greater is given thereto. Thus, even when a drive voltage is applied to the EL element in a forward direction, since electrical charges are charged into the parasitic capacitance, a predetermined time is necessary to reach the light emission threshold voltage. Furthermore, since the constant current drive is performed as described above, its impedance is substantially high, and therefore rising to the light emission threshold voltage of the EL element necessitates a longer time.

In addition, in the case where the above-described means for applying the reverse bias voltage to the EL element is adopted, since electrical charges are accumulated in a reverse bias state in the parasitic capacitance of the EL element, a time period from a time when the forward voltage is applied to a time when the EL element is brought to the light emitting state is further necessary. Thus, a lighting time rate of an EL element decreases, thereby resulting in a substantially deteriorated light-emitting efficiency. Problems that respective EL elements are affected by variations in times that are until EL elements are brought to the light emitting state and the like and therefore linearity of gradation control is deteriorated and the like occur.

SUMMARY OF THE INVENTION

The present invention has been developed as attention to the above-described technical problems has been paid, and it is an object of the present invention, in a drive device for an active type light emitting display panel provided with a TFT as described above or in a drive device for an active type light emitting display panel in which a means for applying a reverse bias voltage to an EL element is adopted, to provide drive methods and drive devices for a light emitting display panel in which a problem that the deteriorated light-emitting efficiency, deterioration of linearity of gradation, or the like occurs as described above can be dissolved.

A drive method for an active type light emitting display panel of a first form according to the present invention which has been developed to solve the above-described problems is, as described in claim 1, a drive method for an active type light emitting display panel provided with a light emitting element, a driving TFT which lighting drives the light emitting element, and a power supply circuit supplying a current of a forward direction to the light emitting element at a lighting operation time of the light emitting element, characterized in that at a timing at which the light emitting element shifts to a lighting operation, a discharge operation is executed in which electrical charges accumulated in a parasitic capacitance of the light emitting element are discharged by setting the electrical potentials of an anode and a cathode of the light emitting element to a same potential.

A drive device for an active type light emitting display panel of the first form according to the present invention is, as described in claim 2, a drive device for an active type light emitting display panel provided with a light emitting element, a driving TFT which lighting drives the light emitting element, and a power supply circuit supplying a current of a forward direction to the light emitting element at a lighting operation time of the light emitting element and is a structure comprising a discharge means operating at a timing at which the light emitting element shifts to a lighting operation and allowing electrical charges accumulated in a parasitic capacitance of the light emitting element to be discharged by setting the electrical potentials of an anode and a cathode of the light emitting element to a same potential.

A drive method for an active type light emitting display panel of a second form according to the present invention is, as described in claim 3, characterized by executing, at a timing at which the light emitting element shifts to a lighting operation, a switching operation of a select switch which gives the light emitting element a potential difference by which lighting is possible and a charge operation for a parasitic capacitance of the light emitting element via the select switch.

A drive device for an active type light emitting display panel of the second form according to the present invention is, as described in claim 4, a structure comprising a charge means operating at a timing at which the light emitting element shifts to a lighting operation and performing charge for a parasitic capacitance of the light emitting element based on a switching function of a select switch which gives the light emitting element a potential difference by which lighting is possible.

A drive method for an active type light emitting display panel of a third form according to the present invention is, as described in claim 5, characterized by executing, at a timing at which the light emitting element shifts to a lighting operation, a charge operation in which a current from a power supply for charge is allowed to flow in the forward direction for a parasitic capacitance of the light emitting element from a connection point between the light emitting element and the driving TFT.

A drive device for an active type light emitting display panel of the third form according to the present invention is, as described in claim 6, a structure comprising a power supply for charge which operates at a timing at which the light emitting element shifts to a lighting operation and which executes a charge operation in the forward direction for a parasitic capacitance of the light emitting element from a connection point between the light emitting element and the driving TFT.

A drive method for an active type light emitting display panel of a forth form according to the present invention is, as described in claim 7, characterized by executing, at a timing at which the light emitting element shifts to a lighting operation, a charge operation in the forward direction for a parasitic capacitance of the light emitting element by a current which is greater than that of the lighting operation time of the light emitting element by controlling a gate voltage of the driving TFT.

A drive device for an active type light emitting display panel of the fourth form according to the present invention is, as described in claim 8, a structure comprising a charge control means which operates at a timing at which the light emitting element shifts to a lighting operation and which performs a charge operation in the forward direction for a parasitic capacitance of the light emitting element by a current which is greater than that of the lighting operation time of the light emitting element by controlling a gate voltage of the driving TFT.

A drive method for an active type light emitting display panel of a fifth form according to the present invention is, as described in claim 9, characterized by executing, at a timing at which the light emitting element shifts to alighting operation, a charge operation in the forward direction for a parasitic capacitance of the light emitting element by performing bypass control for the driving TFT which is connected in series to the light emitting element.

Further, a drive device for an active type light emitting display panel of the fifth form according to the present invention is, as described in claim 10, a structure comprising a bypass control means which operates at a timing at which the light emitting element shifts to a lighting operation and which performs a charge operation in the forward direction for a parasitic capacitance of the light emitting element by bypassing the driving TFT which is connected in series to the light emitting element.

A drive method for an active type light emitting display panel of the fifth form according to the present invention is, as described in claim 9, characterized by executing, at a timing at which the light emitting element shifts to a lighting operation, a charge operation in the forward direction for a parasitic capacitance of the light emitting element by performing bypass control for the driving TFT which is connected in series to the light emitting element.

Further, a drive device for an active type light emitting display panel of the fifth form according to the present invention is, as described in claim 10, a structure comprising a bypass control means which operates at a timing at which the light emitting element shifts to a lighting operation and which performs a charge operation in the forward direction for a parasitic capacitance of the light emitting element by bypassing the driving TFT which is connected in series to the light emitting element.

DESCRIPTION OF THE PREFERRED EMBODIMENTS

Drive devices for a light emitting display panel according to the present invention are classified into first to fifth forms, and respective features thereof will be explained below. A first form of a drive device of a light emitting display panel according to the present invention is characterized in that an anode and a cathode of a light emitting element are set to the same electrical potential at the timing at which the light emitting element shifts to the lighting operation, so that a discharge operation in which the electrical charges accumulated in a parasitic capacitance of the light emitting element are discharged is performed.

Figure 2:
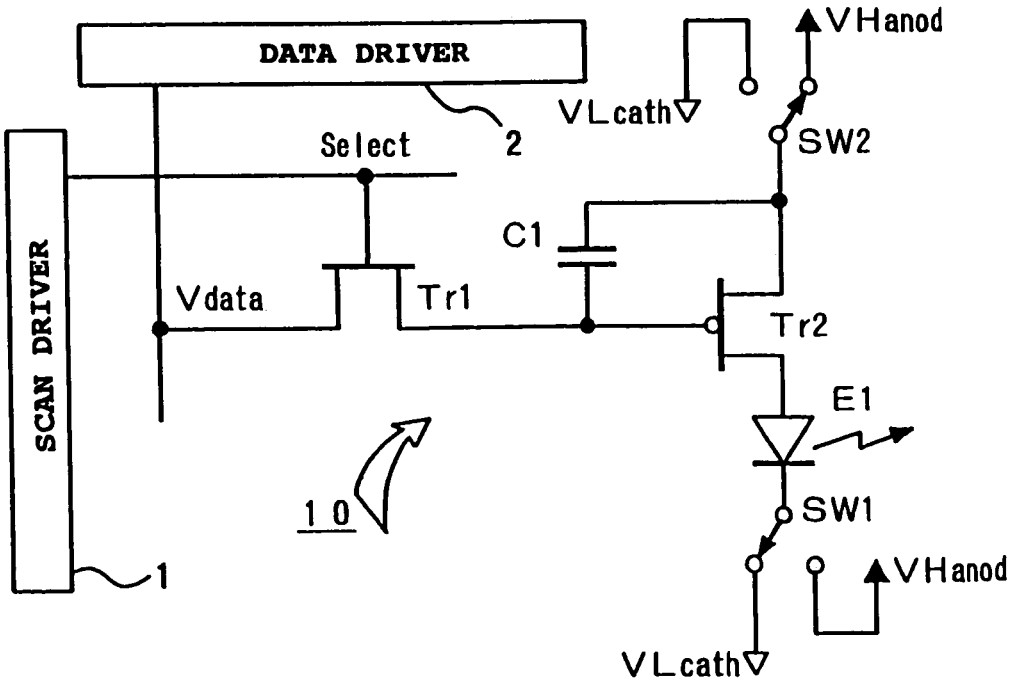
FIG. 2 is, similarly, a connection diagram showing an example of another structure in which a reverse bias voltage can be applied to a light emitting element.

In a first embodiment in the first form of a drive device according to the present invention, first and second change-over switches SW1, SW2 are provided as shown in FIG. 2, and this first embodiment can be applied to an example constructed in such a way that the connection relationship between an anode side power supply (VHanod) and a cathode side power supply (VLcath) is switched by switching the switches SW1, SW2. In each drawing described below, portions corresponding to the respective portions which have been already explained are designated by like reference numerals, and therefore explanation regarding individual functions and operations will be omitted properly.

Figure 3:
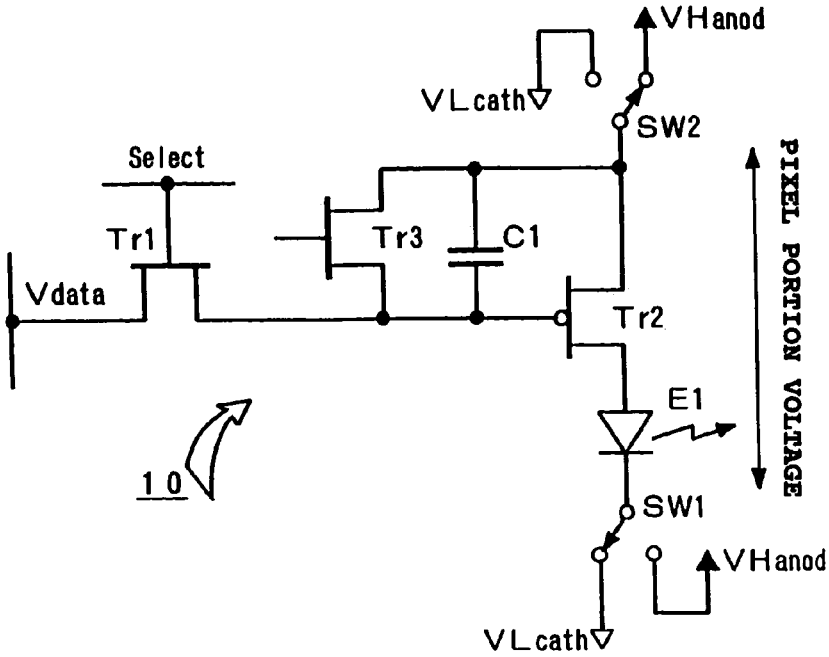
FIG. 3 is a connection diagram showing an example of a pixel structure of a three TFT technique which realizes digital gradation.

The first form of a drive device according to the present invention not only can be applied to one in which a drive means by the conductance control technique is utilized as shown in FIG. 2 but also can be suitably utilized in a light emitting display panel provided with a three TFT technique pixel 10 which realizes digital gradation for example shown in FIG. 3. Further, the first embodiment in the first form of a drive device according to the present invention can be applied similarly to a light emitting display panel provided with a pixel by voltage programming technique, threshold voltage correction technique, or current mirror technique which will be explained later.

In the structure provided with a pixel 10 of the three TFT technique shown in FIG. 3, an erasing TFT (Tr3) is provided for the structure shown in FIG. 2, and by allowing this erasing TFT (Tr3) to perform an ON operation in the middle of a lighting period of the EL element E1, electrical charges of the capacitor C1 can be discharged. Thus, the lighting period of the EL element E1 can be controlled, thereby enabling gradation expression digitally.

Figure 4:
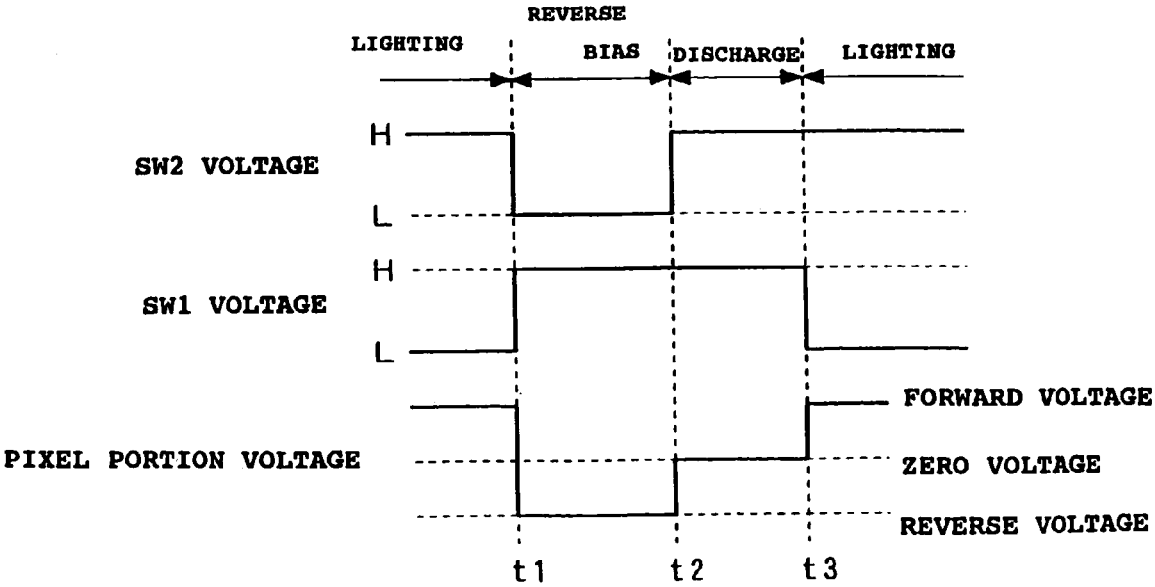
FIG. 4 is timing charts explaining a first embodiment of a first form in a drive device according to the present invention.

FIG. 4 shows switching operation timings of the first and second switches SW1, SW2 in FIGS. 2 and 3. In a lighting state before t1 shown in FIG. 4, the second switch SW2 is connected to the anode side power supply (VHanod). This is shown by a character, "H", in FIG. 4. Also, in the lighting state before t1, the first switch SW1 is connected to the cathode side power supply (VLcath). This is shown by a character, "L", in FIG. 4.

Therefore, in the case where a potential difference of a series circuit including a driving TFT (Tr2) and the EL element E1 is called a pixel portion voltage, a forward voltage of the value of (VHanod−VLcath) is applied as the pixel portion voltage at this time as shown in FIG. 4, and the EL element E1 is brought to a state in which lighting is possible depending on the driving TFT. In FIG. 4, this state is simply marked by "lighting".

Meanwhile, when t1 shown in FIG. 4 is reached, the second switch SW2 is connected to the cathode side power supply (VLcath), and the first switch SW1 is connected to the anode side power supply (VHanod). Thus, a reverse voltage of the value of (VHanod−VLcath) is applied as the pixel portion voltage as shown in FIG. 4, and a reverse bias voltage is applied to the EL element E1 via the driving TFT (Tr2). In FIG. 4, this state is simply marked by "reverse-bias". By this reverse bias voltage applying, electrical charges by the reverse bias voltage are accumulated in the parasitic capacitance of the EL element E1.

Then, when t2 shown in FIG. 4 is reached, only the second switch SW2 is switched to be connected to the anode side power supply (VHanod). Thus, both the first and second switches are connected to the anode side power supply (VHanod), and the pixel portion voltage is brought to zero voltage, that is, a same potential state as shown in FIG. 4. Accordingly, the electrical charges by the reverse bias voltage which have been accumulated in the parasitic capacitance of the EL element E1 are discharged via the driving TFT (Tr2). In FIG. 4, this state is simply marked by "discharge". In other words, the combination of the first and second switches SW1, SW2 and the anode and cathode side power supplies (VHanod), (VLcath) constitutes a discharge means for discharging electrical charges by the reverse bias voltage which have been accumulated in the parasitic capacitance of the EL element.

At t3 after the above-described discharge operation, only the first switch SW1 is switched to be connected to the cathode side power supply (VLcath). Thus, the pixel portion voltage is brought to the forward voltage of the value of (VHanod−VLcath) as shown in FIG. 4, and again the EL element E1 is brought to the state in which lighting is possible depending on the driving TFT (Tr2).

By this operation, at the timing at which an applying state of the reverse bias voltage to the EL element shifts to a supplying state of the forward current, by setting the anode and the cathode of the EL element to the same potential via the driving TFT, the electrical charges by the reverse bias voltage which have been accumulated in the parasitic capacitance of the EL element can be discharged. Accordingly, when a forward bias is applied to the EL element, accumulation of electrical charges in the parasitic capacitance based on the forward bias can be started instantly.

That is, compared to the case where the forward bias is applied even though electrical charges of the reverse bias state have been accumulated in the parasitic capacitance of the EL element, rising for lighting of the EL element can be by far advanced. Thus, a problem that the light-emitting efficiency is deteriorated accompanied by decrease of the lighting time rate of an EL element and the like can be avoided. Since the degree to which respective EL elements are affected by variations in times that are until the EL elements reach the light emitting state and the like can be reduced, a problem that the linearity of gradation control is deteriorated and the like can be improved.

Figure 5:
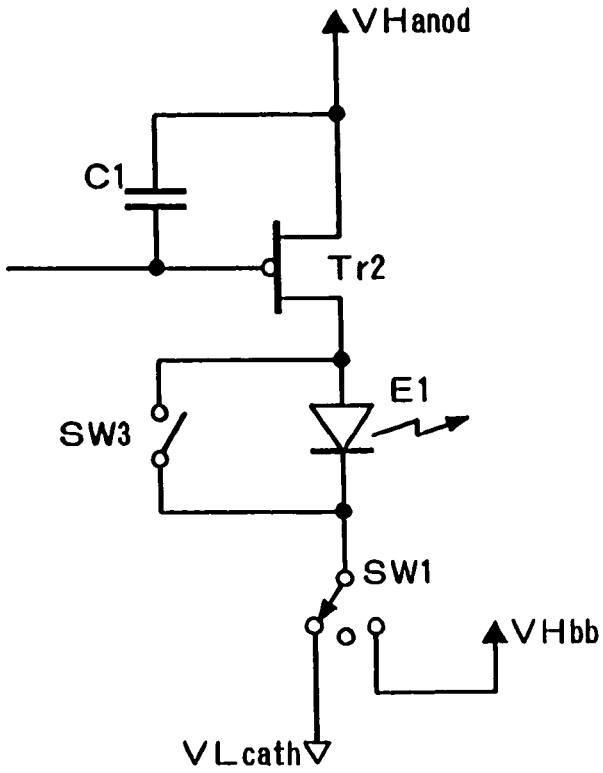
FIG. 5 is a connection diagram showing a second embodiment of the first form similarly.

Next, FIG. 5 explains a second embodiment of the first form of a drive device according to the present invention. This FIG. 5 shows the basic structure comprised of the driving TFT (Tr2), the EL element E1, and the capacitor C1, and other portions are omitted. In the structure shown in this FIG. 5 also, the above-described conductance control technique or a pixel structure of the three TFT technique which realizes digital gradation can be adopted, and further the structure can be similarly applied to a light emitting display panel provided with a pixel by the voltage programming technique, threshold voltage correction technique, or current mirror technique which will be explained later.

In the second embodiment of the first form shown in FIG. 5, a switch SW1 arranged in a cathode side of the EL element E1 constitutes a three input select switch. A switch SW3 is connected between the anode and the cathode of the EL element E1. By switching the switch SW3 on, the anode and the cathode of the EL element E1 can be brought to the state of the same potential. The switch SW3 shown in FIG. 5 is preferably constituted by a TFT.

In the state shown in FIG. 5, the switch SW1 is selecting VLcath, and therefore the forward voltage is supplied to the pixel portion. At this time the switch SW3 is controlled so as to be in an OFF state. Then, the switch SW1 selects VHbb so that the reverse bias voltage is supplied to the pixel portion. At this time also, the switch SW3 is controlled so as to be in the OFF state. By applying of this reverse bias voltage, the electrical charges based on the reverse bias voltage are accumulated in the parasitic capacitance of the EL element E1 as described above.

After this, the switch SW1 selects an empty terminal, that is a high impedance, and at this time the switch SW3 is controlled so as to be in an ON state. Accordingly, at this time the electrical charges based on the reverse bias voltage accumulated in the parasitic capacitance of the EL element E1 are discharged via the switch SW3. Then, after completion of the discharge operation, the switch SW3 is brought to the OFF state, and the switch SW1 is brought to the state to select VLcath shown in FIG. 5. Thus, the forward voltage is applied to the pixel portion again, and the EL element E1 is brought to the state in which lighting is possible depending on the driving TFT (Tr2).

The switch SW3 which interlocks with the switching operation of the select switch SW1 shown in FIG. 5 constitutes a discharge means for discharging electrical charges which have been accumulated in the parasitic capacitance of the EL element. Accordingly, in the structure shown in FIG. 5 also, effects similar to the first embodiment of the first form explained based on FIGS. 2 to 4 can be obtained. In the structure shown in FIG. 5, although the three input select switch SW1 is provided on the cathode side of the EL element E1, even when a fixed power supply is provided on the cathode side of the EL element E1 and the three input select switch is arranged on an anode side of the EL element E1, that is, on the source of the driving TFT via the driving TFT (Tr2), similar interactions and effects can be produced.

Figure 6:
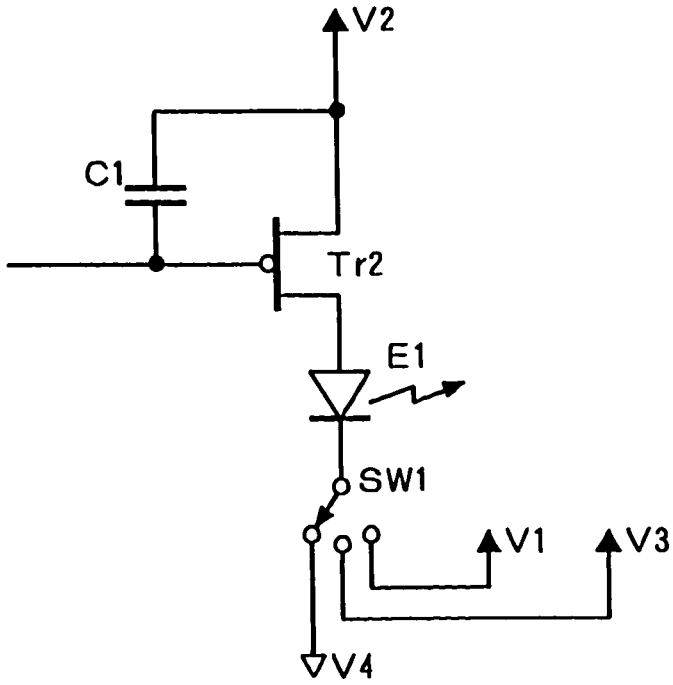
FIG. 6 is a connection diagram showing an embodiment of a second form similarly.

Next, FIG. 6 explains a second form of a drive device according to the present invention. The second form of a drive device according to the present invention is characterized in that at the timing at which the light emitting element shifts to the lighting operation, performed is a switching operation of a select switch which gives a potential difference by which lighting is possible to the light emitting element so as to allow the parasitic capacitance of the light emitting element to perform a charge operation via the select switch.

The second form shown in this FIG. 6 also shows the basic structure comprised of the driving TFT (Tr2), the EL element E1 as the light emitting element, and the capacitor C1, and other portions are omitted. In the structure shown in this FIG. 6 also, the above-described conductance control technique or the pixel structure of three TFT technique which realizes digital gradation can be adopted, and further the structure can be similarly applied to a light emitting display panel provided with a pixel by the voltage programming technique, threshold voltage correction technique, or current mirror technique which will be explained later.

In the second form shown in FIG. 6 also, a switch SW1 arranged on a cathode side of the EL element E1 constitutes a three input select switch so as to be able to select three different potential levels. That is, the switch SW1 is constructed so as to be able to perform multiple choices for respective V4, V1, V3 potential levels as shown in FIG. 6.

Meanwhile, a potential level shown as V2 is applied to the source side of the driving TFT (Tr2). The respective potential levels shown in FIG. 6 have a relationship of V1>V2≧V3>V4.

Figure 1:
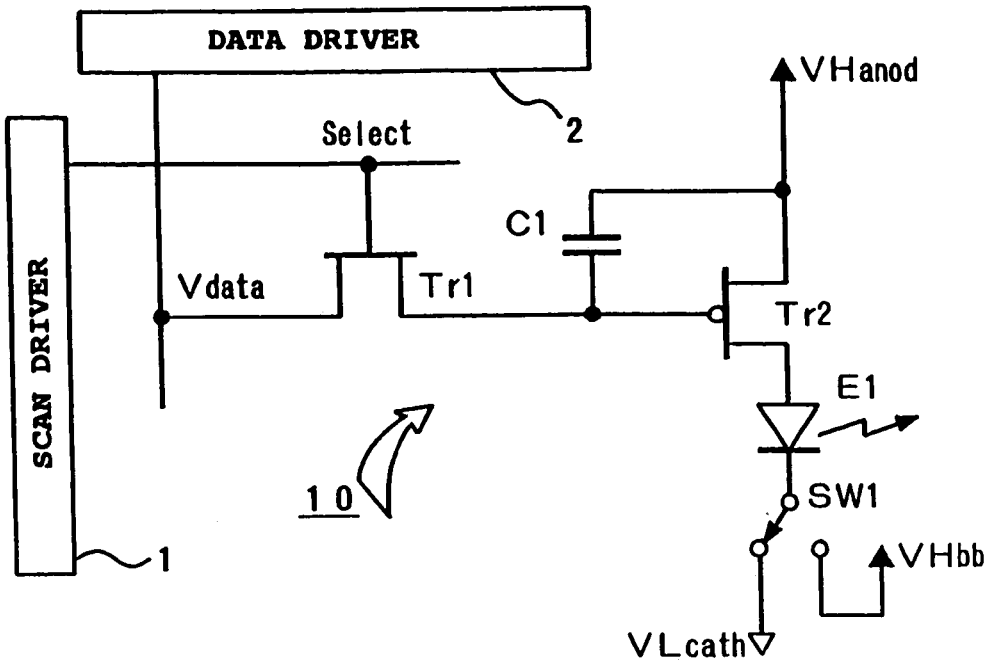
FIG. 1 is a connection diagram showing an example of one pixel structure in an active matrix type display panel in which a reverse bias voltage can be applied to a light emitting element.

That is, the potential level shown as V2 here corresponds to the anode side power supply (VHanod) shown in FIG. 1. The potential level shown as V4 corresponds to the cathode side power supply (VLcath), and further the potential level shown as V1 corresponds to the reverse bias voltage source (VHbb). In the state shown in FIG. 6, the switch SW1 is selecting the potential level shown as V4, and due to this state the forward voltage is applied to the pixel portion and the EL element E1 is brought to the state in which lighting is possible depending on the driving TFT (Tr2).

The switch SW1, from the state shown in FIG. 6, selects the potential level shown as V1. Thus, the reverse bias voltage is applied to the pixel portion, and electrical charges by the reverse bias voltage are accumulated in the parasitic capacitance of the EL element E1. Then, the switch SW1 selects the potential level shown as V3. Here, when V2=V3, the pixel portion voltage becomes zero voltage, that is, the state of the same potential. Accordingly, the electrical charges by the reverse bias voltage which have been accumulated in the parasitic capacitance of the EL element E1 are discharged via the driving TFT (Tr2).

When V2>V3, the electrical charges by the reverse bias voltage which have been accumulated in the parasitic capacitance of the EL element E1 are discharged and at the same time are affected so as to be precharged a bit in the forward direction. Then, the switch SW1 is switched to the state shown in FIG. 6. Thus, the pixel portion voltage becomes the forward voltage, and the EL element E1 again is brought to the state in which lighting is possible depending on the driving TFT (Tr2).

In the structure shown in FIG. 6, a select order of the switch SW1 and the power supplies which specifically has the relationship of V2≧V3 constitute a discharge means for discharging electrical charges by the reverse bias voltage accumulated in the parasitic capacitance of the EL element or a precharge means for charging a bit the forward voltage into the parasitic capacitance of the EL element. Accordingly, in the structure shown in FIG. 6 also, effects similar to those of the first embodiment can be obtained.

In the embodiment shown in FIG. 6, although the three input select switch SW1 is provided on the cathode side of the EL element E1, even when a fixed power supply is provided on the cathode side of the EL element E1 and the three input select switch is arranged on the anode side of the EL element E1, that is, on the source of the driving TFT via the driving TFT (Tr2), similar interactions and effects can be produced.

Figure 7:
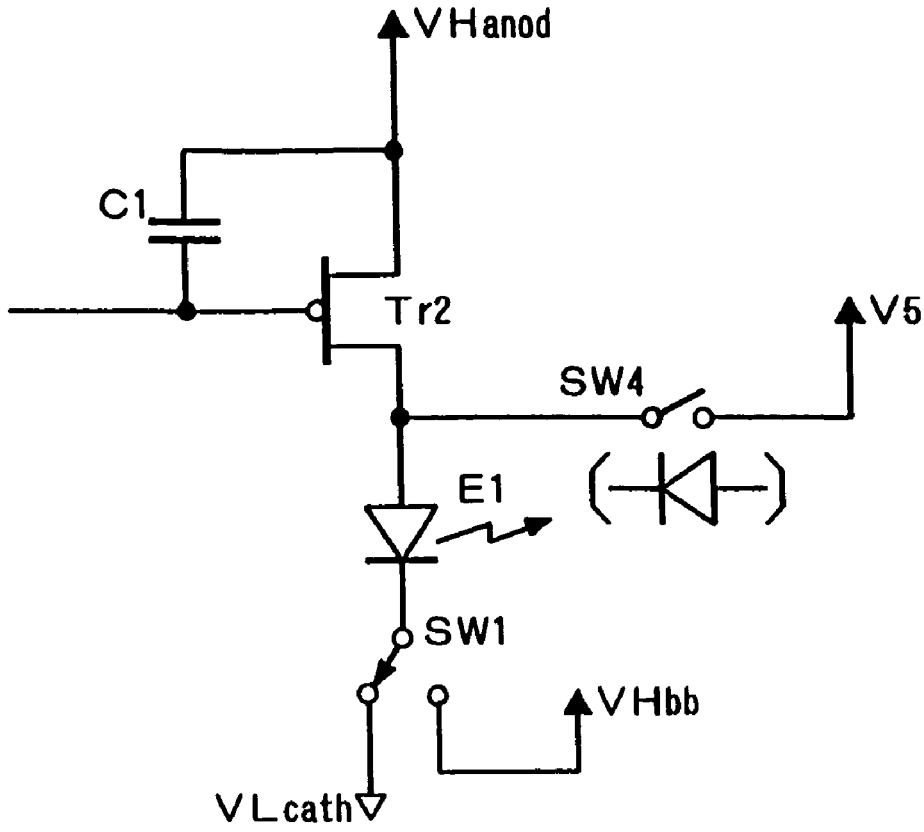
FIG. 7 is a connection diagram showing an embodiment of a third form similarly.

Next, FIG. 7 explains a third form of a drive device according to the present invention. The third form of a drive device according to the present invention is characterized in that at the timing at which the light emitting element shifts to the lighting operation, performed is a charge operation in which current from a power supply for charge is allowed to flow in the forward direction through the parasitic capacitance of the light emitting element via a connection point between the driving TFT and the light emitting element.

This FIG. 7 also shows the basic structure comprised of the driving TFT (Tr2), the EL element E1, and the capacitor C1, and other portions are omitted. In the structure shown in this FIG. 7 also, the above-described conductance control technique or the pixel structure of three TFT technique which realizes digital gradation can be adopted, and further the structure can be similarly applied to a light emitting display panel provided with a pixel by the voltage programming technique, threshold voltage correction technique, or current mirror technique which will be explained later.

In the drive device of the third form shown in FIG. 7, prepared is a power supply for charge V5 which can perform a charge operation in the forward direction into the parasitic capacitance of the EL element via the connection point between the EL element E1 as the light emitting element and the driving TFT (Tr2). In this case, the charging power supply V5 is constructed as a constant voltage supply and works so as to perform the charge operation in the forward direction into the parasitic capacitance of the EL element E1 via a switch SW4.

That is, in the state shown in FIG. 7, the switch SW1 is selecting VLcath, and therefore the forward voltage is supplied to the pixel portion. At this time the switch SW4 is controlled so as to be in an OFF state. Then, the switch SW1 selects VHbb so that the reverse bias voltage is supplied to the pixel portion. At this time also the switch SW4 is controlled so as to be in the OFF state. By this applying of the reverse bias voltage, as described above, the electrical charges based on the reverse bias voltage are accumulated in the parasitic capacitance of the EL element E1.

Then, the switch SW1 returns to the state of the beginning shown in FIG. 7, that is, to the state of the forward bias. At the same time the switch SW4 is controlled to be in an ON state. Accordingly, although the electrical charges based on the reverse bias voltage have been accumulated in the parasitic capacitance of the EL element E1, at this time, since the voltage of the charging power supply V5 which is supplied via the switch SW4 is supplied to the parasitic capacitance in the forward direction, the forward voltage by the charging power supply V5 is charged instantly into the parasitic capacitance of the EL element E1. As described above, since the charging power supply V5 is constructed as a constant voltage source, the charge operation in the forward direction is performed momentarily.

After a predetermined period of time (time period until the charge operation is completed) elapses, the switch SW4 is brought to the OFF state. Accordingly, the forward voltage is applied to the pixel portion again, and the EL element E1 is brought to the state in which lighting is possible depending on the driving TFT (Tr2).

With the drive device of the third form shown in FIG. 7 according to the present invention, at the timing at which the applying state of the reverse bias voltage to the EL element shifts to the supplying state of the forward current, since performed is a charge operation for allowing current to flow in the forward direction from the power supply for charge to the parasitic capacitance of the EL element via the connection point between the EL element and the driving TFT, the electrical charges by the reverse bias voltage which have been accumulated in the parasitic capacitance of the EL element can be discharged instantly and the electrical charges based on the forward bias can be accumulated momentarily in the parasitic capacitance of the EL element.

Thus, rising for lighting of the EL element can be advanced, and the problem that the light-emitting efficiency is deteriorated accompanied by decrease of the lighting time rate of an EL element and the like can be avoided. Since the degree to which respective EL elements are affected by variations in times that are until the EL elements reach the light emitting state and the like can be reduced, the problem that the linearity of gradation control is deteriorated and the like can be improved.

In the embodiment shown in FIG. 7, connecting for example a diode instead of the switch SW4 in the direction shown in the drawing is also effective. That is, as shown in FIG. 7, by applying the forward voltage to the pixel and by setting so that the anode voltage level of when the forward voltage is charged into the parasitic capacitance of the EL element and the voltage level of the charging power supply V5 are approximately the same, the diode can be controlled automatically so as to be in an OFF state by its threshold voltage. In the case of this structure, it becomes unnecessary to particularly provide control logic for performing ON/OFF control for the switch SW4 and a control line.

Next, FIGS. 8 to 16 explain a fourth form in drive devices according to the present invention. The fourth form of a drive device according to the present invention is characterized in that at the timing at which the light emitting element shifts to the lighting operation, performed is a charge operation by current which is greater than that of the lighting operation time of the light emitting element into the parasitic capacitance of the light emitting element in the forward direction by controlling the gate voltage of the driving TFT.

Figure 8:
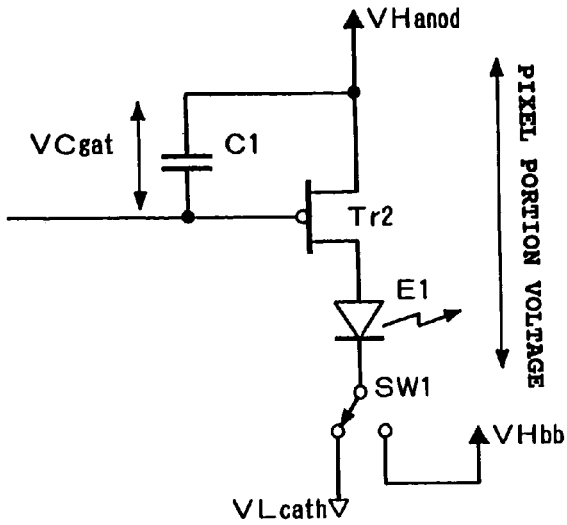
FIG. 8 is a connection diagram showing an example of a basic structure of a fourth form similarly.
Figure 9:
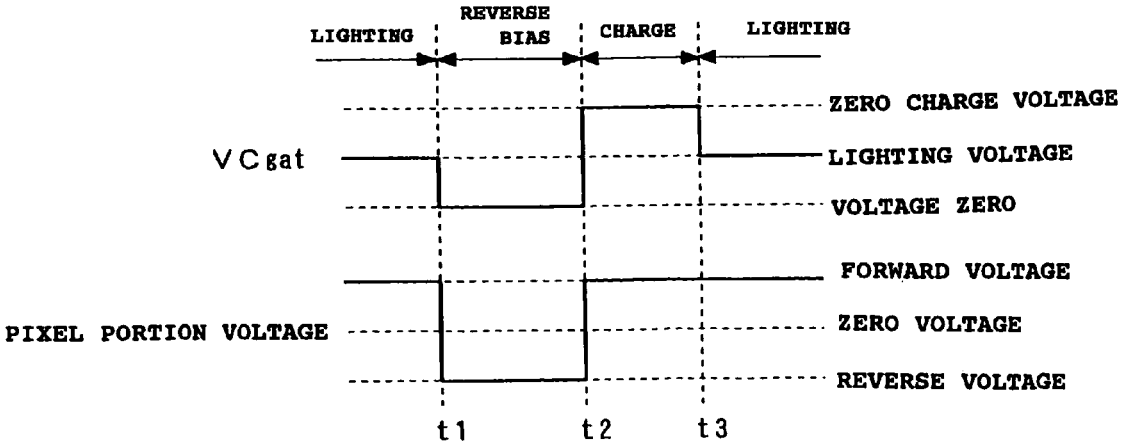
FIG. 9 is timing charts explaining operations in the example of the basic structure shown in FIG. 8.

First, FIG. 8 shows a basic structure of the fourth form in a drive device according to the present invention, and FIG. 9 is timing charts explaining its basic operations. In this FIG. 8 also, the basic structure comprised of the driving TFT (Tr2), the EL element E1 as the light emitting element, and the capacitor C1 is shown, and other portions are omitted. As shown in FIG. 9, in the lighting state before t1 is reached, the switch SW1 shown in FIG. 8 is brought to the state of the drawing, and the pixel portion voltage is brought to the state of the forward direction. Then when t1 is reached, the switch SW1 is switched to the VHbb side so that the pixel portion voltage is brought to the reverse bias voltage, that is, the reverse bias state.

At this time the embodiment shown in FIG. 8 is constructed in such a way that the voltage of the same level as VHanod is applied to the gate of the driving TFT (Tr2). That is, when both end voltages of the capacitor C1 is VCgat, an operation by which VCgat is brought to the state of zero voltage (the same potential) is performed. In this state, the electrical charges by the reverse bias voltage are accumulated in the parasitic capacitance of the EL element E1.

When t2 is reached, the switch SW1 returns to the state shown in FIG. 8, and the pixel portion voltage is brought to the state of the forward voltage. At this time a bias voltage which is sufficient to bring the driving TFT to the ON state is supplied to the gate of the driving TFT (Tr2). That is, as shown in FIG. 9, VCgat is set to a value of "zero charge voltage". Thus, during a momentary period (a charge period shown in FIG. 9), a forward current which is greater than that of its lighting state flows through the EL element E1 via the driving TFT (Tr2) and therefore electrical charges by the forward current are accumulated momentarily in the parasitic capacitance of the EL element. When t3 is reached, the voltage to be applied to the gate of the driving TFT (Tr2) is set to a preset lighting voltage for allowing a predetermined constant current to flow through the EL element E1.

With the structure of FIG. 8 and the control form shown in FIG. 9, at the timing at which the applying state of the reverse bias voltage to the EL element shifts to the supplying state of the forward current, by controlling the gate voltage of the driving TFT, performed is a charge operation in the forward direction into the parasitic capacitance of the EL element by a current which is greater than that of the lighting operation time of the EL element. Thus, rising for lighting of the EL element can be advanced, and the problem that the light-emitting efficiency is deteriorated accompanied by decrease of the lighting time rate of the EL element and the like can be avoided. Since the degree to which respective EL elements are affected by variations in times that are until the EL elements reach the light emitting state and the like can be reduced, the problem that the linearity of gradation control is deteriorated and the like can be improved.

Figure 10:
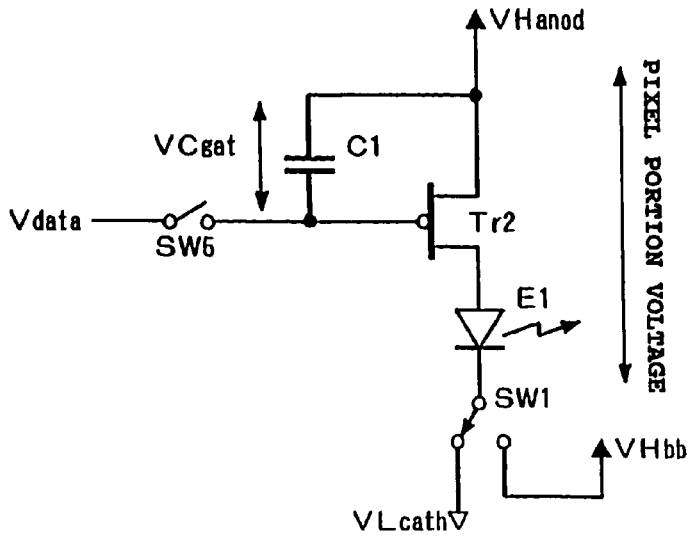
FIG. 10 is a connection diagram showing a first embodiment of the fourth form in a drive device according to the present invention.
Figure 11:
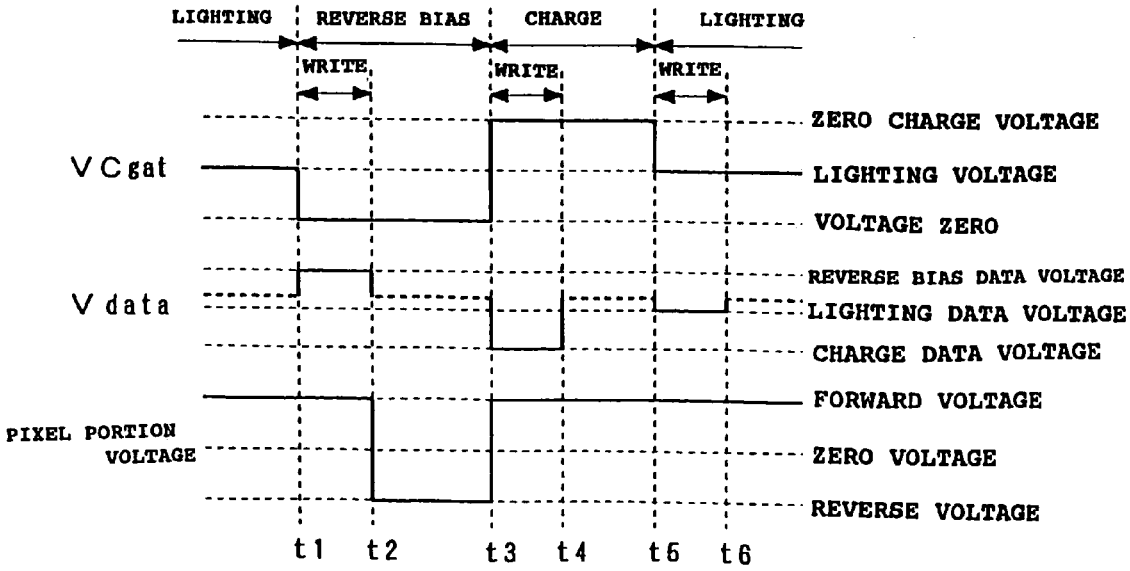
FIG. 11 is timing charts explaining operations in the example of the basic structure shown in FIG. 10.

FIG. 10 shows a first embodiment of the fourth form in a drive device according to the present invention, explaining a basic structure based on FIGS. 8 and 9, and FIG. 11 is timing charts explaining more detailed operations of this case. In FIG. 10, a switch SW5 equivalently shows the controlling TFT (Tr1) in the structure shown in FIG. 1, and in this case, it can be stated that FIG. 10 is made to a pixel structure by the conductance control technique.

The structure shown in FIG. 10 is constructed so that Vdata produced from the data driver produces respective reverse bias data voltage, charge data voltage, and lighting data voltage at respective beginning timings of the applying period of the reverse bias voltage, the charge period of the forward current, and the following lighting period as shown in FIG. 11. At the time at which these respective data voltages arrive, the switch SW5 is brought to an ON state, and write operations are performed based on the respective data voltages. VCgat shown in FIG. 11 and a set operation pattern of the pixel portion voltage are similar to the pattern shown in FIG. 9 which has been already explained.

In stead of the pixel structure by the conductance control technique shown in FIG. 10 described above, the three TFT technique which realizes digital gradation shown in FIG. 3 can be adopted. In this case also, a drive operation shown in FIG. 11 can be adopted suitably, and the problem that the light-emitting efficiency of the EL element is deteriorated and the like can be avoided. Further, the problem that the linearity of gradation control is deteriorated and the like can be improved.

Figure 12:
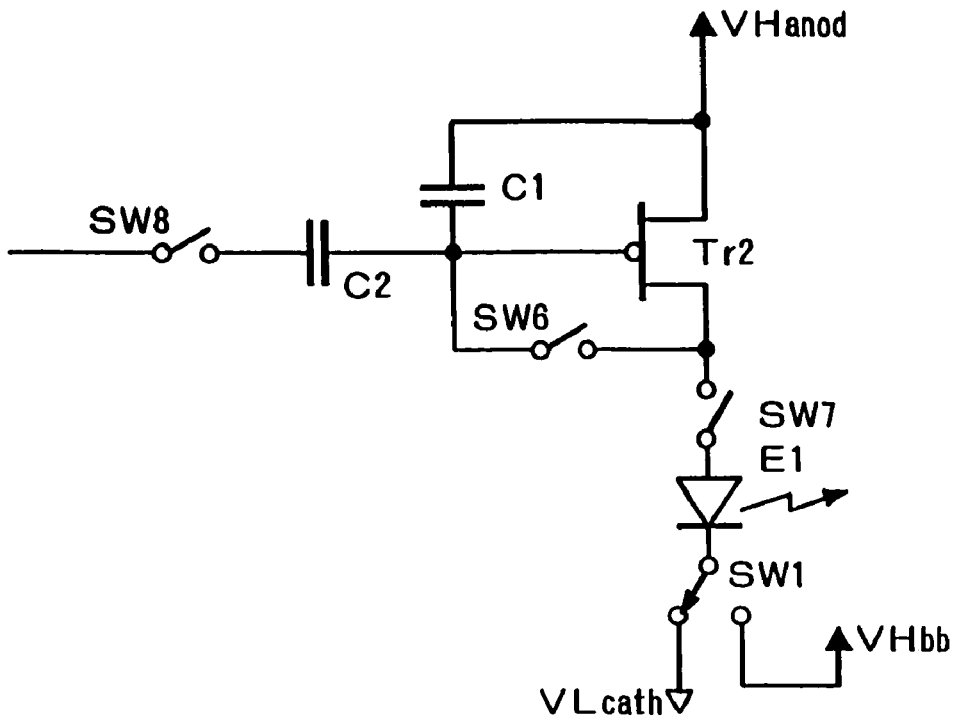
FIG. 12 is a connection diagram showing a second embodiment of the fourth form in a drive device according to the present invention.

FIG. 12 shows a second embodiment of the fourth form according to the present invention, and the pixel structure shown in this FIG. 12 is called the voltage programming technique. In this voltage programming technique, a switch SW7 is connected in series between the drain of the driving TFT (Tr2) and the anode of the EL element E1. The capacitor C1 for holding electrical charges is connected between the gate and the source of the driving TFT (Tr2), and a switch SW6 is connected between the gate and the drain of the driving TFT (Tr2). In addition, this voltage programming technique is constructed in such a way that a data signal is supplied from the data line to the gate of the driving TFT (Tr2) via a switch SW8 and a capacitor C2.

In the voltage programming technique, the switch SW6 and the switch SW7 are turned on, and with this operation, the ON state of the driving TFT (Tr2) is ensured. At a next moment, the switch SW7 is turned off so that a drain current of the driving TFT (Tr2) enters the gate of the driving TFT (Tr2) via the switch SW6. Thus, the voltage between the gate and the source of the driving TFT (Tr2) is boosted until it becomes equal to the threshold voltage of the driving TFT (Tr2), and at this time the switch SW6 is turned off.

The gate-to-source voltage of this time is held by the capacitor C1, and the drive current of the EL element E1 is controlled by this capacitor voltage. That is, this voltage programming technique works so as to compensate variations in threshold voltages in driving TFTs (Tr2). In the structure utilizing a drive means by the voltage programming technique shown in FIG. 12 also, the drive operation shown in FIG. 11 can be adopted suitably, and the problem that the light-emitting efficiency of the EL element is deteriorated and the like can be avoided. Further, the problem that the linearity of gradation control is deteriorated and the like can be improved.

Figure 13:
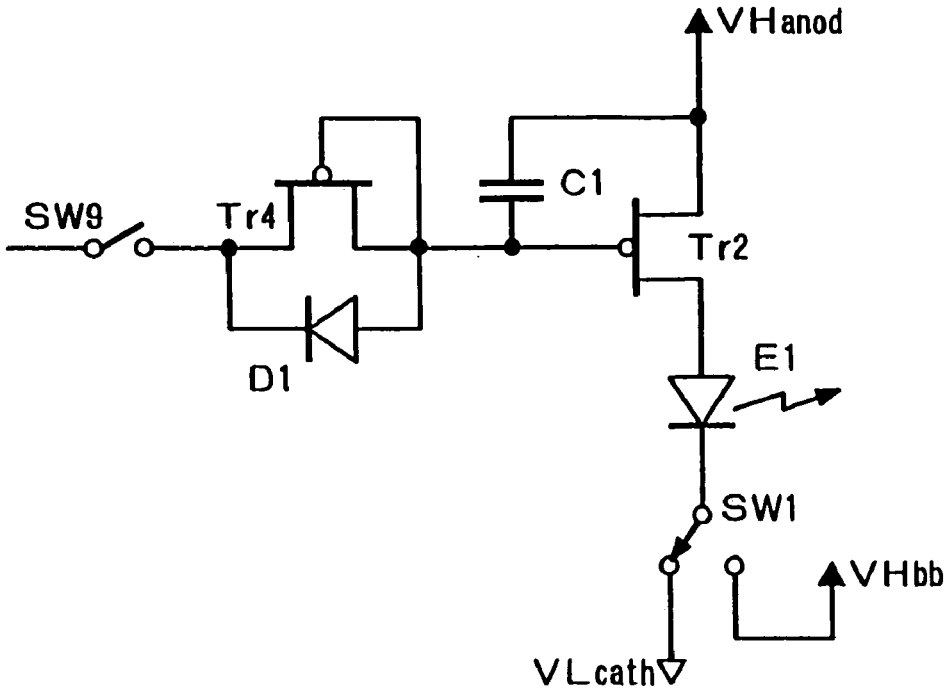
FIG. 13 is a connection diagram showing a third embodiment of the fourth form similarly.

FIG. 13 shows a third embodiment of the fourth form according to the present invention, and the structure shown in this FIG. 13 is called the threshold voltage correction technique herein. In this threshold voltage correction technique shown in FIG. 13, the EL element E1 is connected in series to the driving TFT (Tr2), and the capacitor C1 for holding electrical charges is connected between the gate and the source of the driving TFT (Tr2). That is, this basic structure is similar to that shown in FIG. 1.

In the structure shown in FIG. 13, a parallel connection part of a TFT (Tr4) and a diode D1 is inserted between a switch SW9 (this is equivalent to the controlling TFT (Tr1)) connected to the data line and the gate of the driving TFT (Tr2). The TFT (Tr4) is constructed so that its gate and-drain are in a short circuit state, and therefore this TFT functions as an element which imparts a threshold characteristic from the switch SW9 toward the gate of the driving TFT (Tr2).

With this structure, since threshold characteristics in mutual TFTs (Tr2, Tr4) formed in one pixel-is made to a very similar characteristic, the threshold characteristics can be effectively cancelled. In the structure utilizing the threshold voltage correction technique shown in FIG. 13 also, the drive operation shown in FIG. 11 can be adopted suitably, and the problem that the light-emitting efficiency of the EL element is deteriorated and the like can be avoided. Further, the problem that the linearity of gradation control is deteriorated and the like can be improved.

Figure 14:
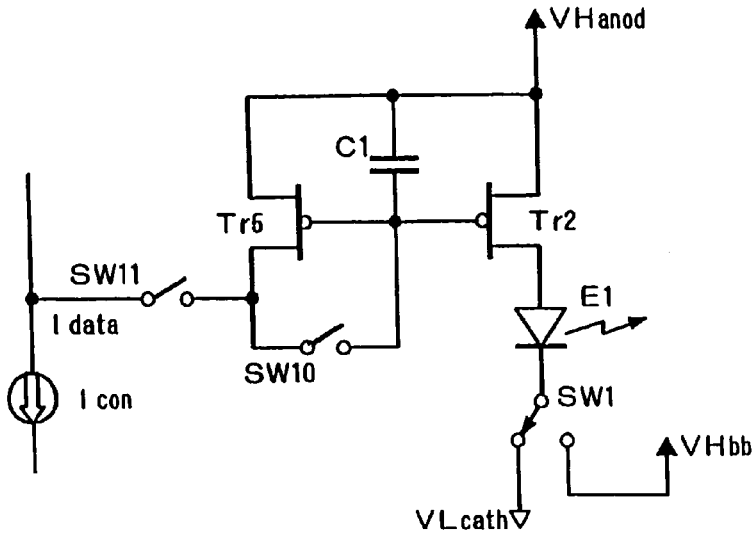
FIG. 14 is a connection diagram showing a fourth embodiment of the fourth form similarly.

FIG. 14 shows a fourth embodiment of the fourth form according to the present invention, and the structure shown in this FIG. 14 shows an example of a drive means for the EL element by the so-called current mirror technique and is constructed in a way that by a current mirror operation a data write process to the electrical charge holding capacitor C1 and the lighting drive operation of the EL element E1 are performed.

That is, a TFT (Tr5) whose gate is commonly connected to the driving TFT (Tr2) is symmetrically provided, and the electrical charge holding capacitor C1 is connected between the gate and the source of both TFTs (Tr2, Tr5).

A switch SW10 is connected between the gate and the drain of the TFT (Tr5), and by an ON operation of this switch SW10 both TFTs (Tr2, Tr5) function as a current mirror. That is, with the On operation of the switch SW10 a switch SW11 is also brought to an ON operation, and by this operation this embodiment is constructed so that a writing current source Icon is connected via the switch SW11.

Thus, for example during an address period, formed is a current route on which current flows from the power supply of VHanod to the writing current source Icon via the TFT (Tr5) and the switch SW11. By the function of the current mirror, a current corresponding to the current flowing through the current source Icon is supplied to the EL element E1 via the driving TFT (Tr2). By this operation a gate voltage of the TFT (Tr5) which corresponds to a current value flowing through the writing current source Icon is written in the capacitor C1. After a predetermined voltage value is written in the capacitor C1, the switch SW10 is brought to an OFF state, and the driving TFT (Tr2) operates so as to supply a predetermined current to the EL element E1 based on the electrical charges accumulated in the capacitor C1, whereby the EL element E1 is light emission driven.

Figure 15:
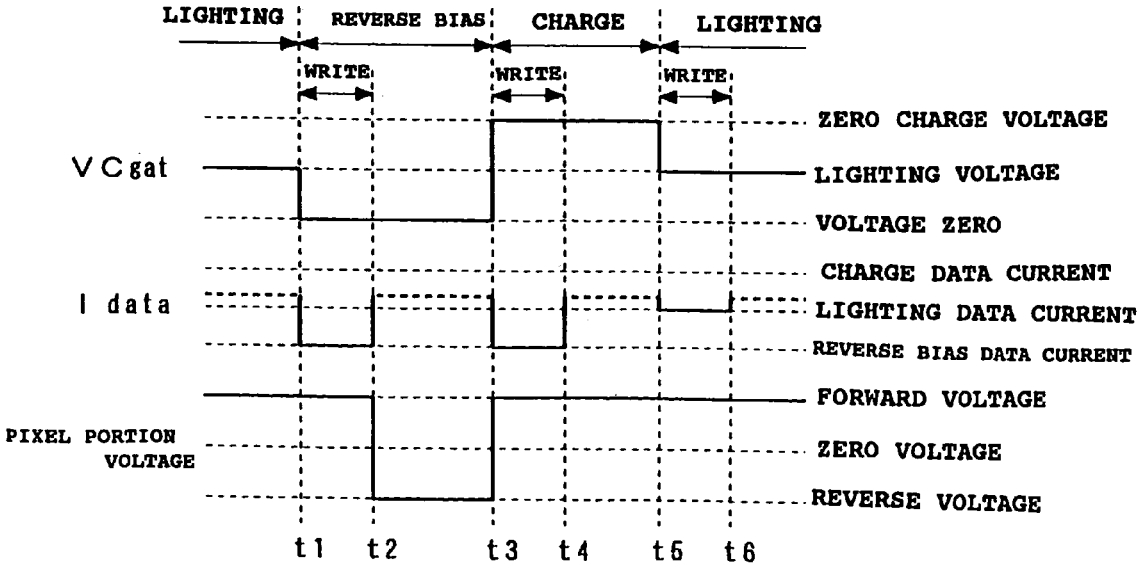
FIG. 15 is timing charts explaining operations in the example of the basic structure shown in FIG. 14.

FIG. 15 shows operation timings performed in the drive means of the EL element by the current mirror technique. The operation timings shown in this FIG. 15 are performed approximately similarly to those of FIG. 11 which has been already explained. However, the drive means of the EL element by the current mirror technique operates as a current write type. Accordingly, a write operation is performed by a data current Idata produced by the current source Icon.

As shown in FIG. 15, at respective beginning timings of the applying period of the reverse bias voltage, the charge period of the forward current, and the following lighting period, the Idata produced from the current source Icon is made so as to produce respective reverse bias data current, charge data current, and lighting data current at respective beginning timings of the applying period of the reverse bias voltage, the charge period of the forward current, and the following lighting period. Every time these respective data currents arrive, the switch SW10 is brought to an ON state, and the write operation is performed based on the respective data current. By adopting the drive operation shown in FIG. 15, the problem that the light-emitting efficiency of the EL element is deteriorated and the like can be avoided, and also the problem that the linearity of gradation control is deteriorated and the like can be improved.

Figure 16:
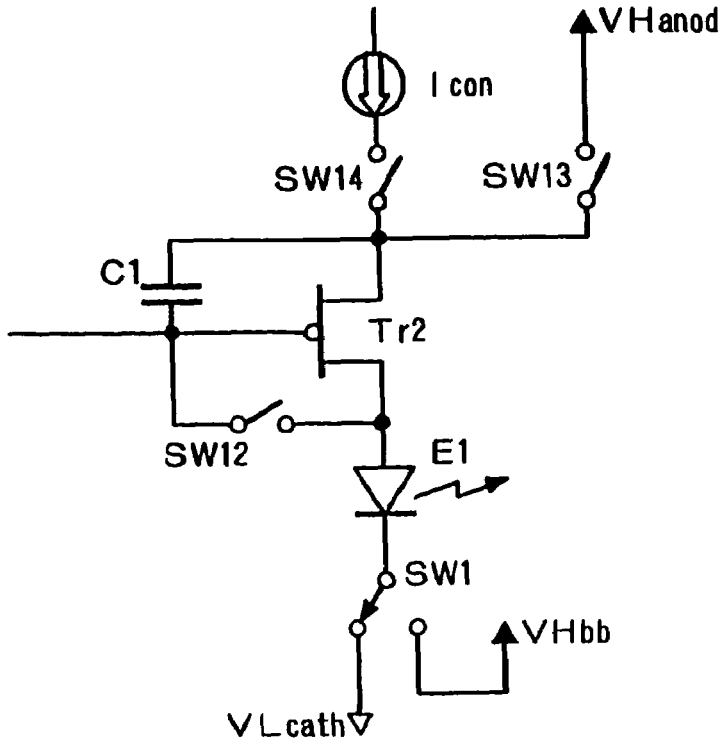
FIG. 16 is a connection diagram showing a fifth embodiment of the fourth form in a drive device according to the present invention.

FIG. 16 shows a fifth embodiment of the fourth form according to the present invention, and this FIG. 16 shows an example of a drive means for the EL element by the current programming technique. This current programming technique is constructed in a way that a series circuit of a switch SW13, the driving TFT (Tr2), and the EL element E1 is inserted between the anode side power supply (VHanod) and the cathode side power supply (VLcath). The electrical charge holding capacitor C1 is connected between the source and the gate of the driving TFT (Tr2), and a switch SW12 is connected between the gate and the drain of the driving TFT (Tr2). Further, the writing current source Icon is connected to the source of the driving TFT (Tr2) via a switch SW14.

In the structure shown in FIG. 16, the respective switches SW12, SW14 are brought to ON states so that the driving TFT (Tr2) is also turned on, whereby current from the writing current source Icon flows through the driving TFT (Tr2). At this time a voltage corresponding to the current from the writing current source Icon is held in the capacitor C1.

During the light emission operation time of the EL element, the switches SW12, SW14 are both brought to OFF states, and the switch SW13 is turned on. Thus, the anode side power supply (VHanod) is applied to the source side of the driving TFT (Tr2), and the cathode side power supply (VLcath) is applied to the cathode of the EL element E1. The drain current of the driving TFT (Tr2) is determined by the electrical charges held in the capacitor C1 so that gradation control of the EL element is performed.

In the structure in which the drive means by the current programming technique shown in FIG. 16 is utilized also, the drive operation shown in FIG. 15 can be adopted suitably, and the problem that the light-emitting efficiency of the EL element is deteriorated and the like can be avoided. Further, the problem that the linearity of gradation control is deteriorated and the like can be improved.

With the drive means according to the fourth form of the present invention shown in FIGS. 8 to 16 which have been explained, at the timing at which the applying state of the reverse bias voltage to the EL element shifts to the supplying state of the forward current, by controlling the gate voltage of the driving TFT, provided is the charge means for performing the charge operation in the forward direction into the parasitic capacitance of the EL element by the current which is greater than that of the lighting operation time of the EL element. Accordingly, as described above, the light-emitting efficiency of the EL element can be effectively compensated, and deterioration in the linearity of gradation control can be prevented.

Figure 17:
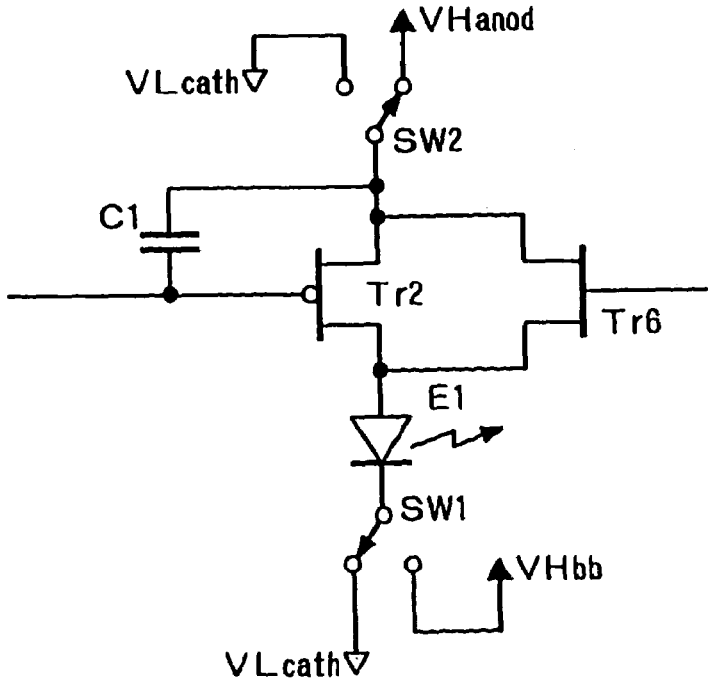
FIG. 17 is a connection diagram showing an embodiment of a fifth form similarly.

Next, FIG. 17 explains a fifth form of a drive device according to the present invention. The fifth form of a drive device according to the present invention is characterized in that at the timing at which the light emitting element shifts to the lighting operation, by performing bypass control for the driving TFT connected in series to the light emitting element, a charge operation is performed for the parasitic capacitance of the light emitting element in the forward direction.

In this FIG. 17 also, the basic structure comprised of the driving TFT (Tr2), the EL element E1 as the light emitting element, and the capacitor C1 is shown, and other portions are omitted. In the structure shown in this FIG. 17 also, the above-described conductance control technique or a pixel structure of the three TFT technique which realizes digital gradation can be adopted suitably, and further the structure can be similarly applied to a light emitting display panel provided with a pixel by the voltage programming technique, threshold voltage correction technique, or current mirror technique which have been explained already.

In the drive device of the fifth form shown in FIG. 17, respective source and drain of a TFT (Tr6) comprised of N-channels are connected to the respective source and drain of the driving TFT (Tr2) comprised of P-channels in a parallel state. Although not particularly shown, a predetermined bias voltage (constant voltage) is supplied to the gate of the TFT (Tr6) comprised of N-channels. That is, the TFT (Tr6) constitutes a bypass control means for bypassing and for constant-voltage driving the driving TFT (Tr2) which performs a constant current operation.

In the structure shown in FIG. 17, the forward current is supplied to the EL element E1 in the state of the switches SW1, SW2 shown in the drawing, and the reverse bias voltage is supplied to the EL element E1 when the switches SW1, SW2 are switched to the state opposite to that of the drawing, which has been already explained. With the embodiment shown in FIG. 17, the applying state of the reverse bias voltage shifts to the supplying state of the forward current, and a charge operation in which electrical charges are rapidly accumulated in the parasitic capacitance, bypassing the TFT (Tr6), is performed in the state in which the amount of electrical charges of the forward voltage into the parasitic capacitance of the EL element E1 is small. Accordingly, the EL element can be rapidly raised to a light emitting state.

Meanwhile, when a predetermined charge operation is performed in the forward direction for the parasitic capacitance of the EL element, since the source voltage of the TFT (Tr6) increases, the TFT (Tr6) comprised of N-channels automatically shifts to a cutoff state, and the above-described bypass operation is stopped.

The drive device of the fifth form shown in FIG. 17 also, similarly, can effectively compensate the light-emitting efficiency of the EL element and can contribute to prevention of deterioration in the linearity of gradation control.

Although the respective embodiments explained above are all made to power supply structures in which a reverse bias voltage can be applied to the EL element, the present invention is not limited to this, and applying the present invention to a display panel provided with a pixel structure which is actively driven enables the light-emitting efficiency of the EL element to effectively compensated and similarly enables deterioration in the linearity of gradation control to be prevented.

What is claimed is:

1. A drive method for an active type light emitting display panel provided with a light emitting element, a driving TFT which lighting drives the light emitting element, a power supply circuit supplying a current of a forward direction to the light emitting element at a lighting operation time of the light emitting element and a circuit to apply a reverse bias voltage to said light emitting element, wherein either one of a discharge operation in which electrical charges accumulated in a parasitic capacitance of the light emitting element are discharged and a charge operation for said parasitic capacitance is executed, at the timing at which the applying operation of the reverse bias voltage to the EL element shifts to the supplying operation of the forward current.

2. A drive method for an active type light emitting display panel according to claim 1, wherein, a discharge operation in which electrical charges accumulated in a parasitic capacitance of the light emitting element are discharged is executed, at the timing at which the applying operation of the reverse bias voltage to the EL element shifts to the supplying operation of the forward current, by setting the electrical potentials of an anode and a cathode of the light emitting element to a same potential.

3. A drive method for an active type light emitting display panel according to claim 1, wherein, a switching operation of a select switch which gives the light emitting element a potential difference by which lighting is possible is executed, at the timing at which the applying operation of the reverse bias voltage to the EL, element shifts, and a charge operation for a parasitic capacitance of the light emitting element via the select switch is executed.

4. A drive method for an active type light emitting display panel according to claim 1, wherein, a charge operation in which a current from a power supply for charge is allowed to flow in the forward direction for a parasitic capacitance of the light emitting element from a connection point between the light emitting element and the driving TFT at the timing at which the applying operation of the reverse bias voltage to the EL element shifts to the supplying operation of the forward current.

5. A drive method for an active type light emitting display panel according to claim 1 wherein, a charge operation in the forward direction for a parasitic capacitance of the light emitting element by a current which is greater than that of the lighting operation time of the light emitting element is executed, at the timing at which the applying operation of the reverse bias voltage to the EL element shifts to the supplying operation of the forward current, by controlling a gate voltage of the driving TFT.

6. A drive method for an active type light emitting display panel according to claim 1, wherein, a charge operation in the forward direction for a parasitic capacitance of the light emitting element is executed, at the timing at which the applying operation of the reverse bias voltage to the EL element shifts to the supplying operation of the forward current, by performing bypass control for the driving TFT which is connected in series to the light emitting element.

7. A drive device for an active type light emitting display panel provided with a light emitting element, a driving TFT which lighting drives the light emitting element, a power supply circuit supplying a current of a forward direction to the light emitting element at a lighting operation time of the light emitting element, and a circuit to apply a reverse bias voltage to said light emitting element, wherein there is provided either one of a discharge means to allow electrical discharge of charges accumulated in a parasitic capacitance of the light emitting element and a charge means which performs a charge for the parasitic capacitance of the light emitting element, at the timing at which the applying operation of the reverse bias voltage to the EL element shifts to the supplying operation of the forward current.

8. A drive device for an active type light emitting display panel according to claim 7, wherein said discharge means operates at the timing at which the applying operation of the reverse bias voltage to the EL element shifts to the supplying operation of the forward current and is adapted to discharge the electrical charges accumulated in the parasitic capacitance of the light emitting element by setting the electrical potentials of an anode and a cathode of the light emitting element to a same potential.

9. A drive device for an active type light emitting display panel according to claim 7, wherein said charge means which performs a charge operation for the parasitic capacitance of the light emitting element operates at the timing at which the applying operation of the reverse bias voltage to the EL element shifts to the supplying operation of the forward current and performs a charging operation for the parasitic capacitance of the light emitting element on the basis of a switching function of a select switch which gives the light emitting element a potential difference by which lighting is possible.

10. A drive device for an active type light emitting display panel according to claim 7, wherein said charge means which performs a charge operation for the parasitic capacitance of the light emitting element operates at the timing at which the applying operation of the reverse bias voltage to the EL element shifts to the supplying operation of the forward current and executes a charging operation in a forward direction for the parasitic capacitance of the light emitting element from a connection point between the light emitting element and the driving TFT.

11. A drive device for an active type light emitting display panel according to claim 7, wherein said charge means which performs a charge operation for the parasitic capacitance of the light emitting element operates at the timing at which the applying operation of the reverse bias voltage to the EL element shifts to the supplying operation of the forward current and executes a charging operation for the parasitic capacitance of the light emitting element and performs a charge operation in a forward direction for a parasitic capacitance of the light emitting element by a current which is greater than that of the lighting operation time of the light emitting element by controlling a gate voltage of the driving TFT.

12. A drive device for an active type light emitting display panel according to claim 7, wherein said charge means which performs a charge operation for the parasitic capacitance of the light emitting element operates at the timing at which the applying operation of the reverse bias voltage to the EL element shifts to the supplying operation of the forward current, and executes a charge operation in a forward direction for a parasitic capacitance of the light emitting element includes a bypass control means for bypassing the driving TFT which is connected in series to the light emitting element.

13. The drive device for an active type light emitting display panel according to any one of claims 7 to 12, wherein the light emitting element is constituted by an organic EL element in which an organic compound is employed in a light emitting layer.

* * * * *

UNITED STATES PATENT AND TRADEMARK OFFICE

CERTIFICATE OF CORRECTION

PATENT NO. : 7,193,589 B2
APPLICATION NO. : 10/699704
DATED : March 20, 2007
INVENTOR(S) : Takayoshi Yoshida et al.

It is certified that error appears in the above-identified patent and that said Letters Patent is hereby corrected as shown below:

Claims

Please change "the EL element" to --the light emitting element-- at Column 16, lines 18, 26, 36, 46, 56, and 64; Column 17, lines 13, 18, and 29; and Column 18, lines 2, 12, and 25.

Signed and Sealed this

Eighteenth Day of December, 2007

JON W. DUDAS
*Director of the United States Patent and Trademark Office*